US005202541A

United States Patent [19]

Patterson et al.

[11] Patent Number: 5,202,541

[45] Date of Patent: Apr. 13, 1993

[54] MICROWAVE HEATING OF WORKPIECES

[75] Inventors: Mark C. L. Patterson; Raymond Y. Roy, both of Kingston; Robert M. Kimber, Sydenham; Prasad S. Apté, Kingston, all of Canada

[73] Assignee: Alcan International Limited, Montreal, Canada

[21] Appl. No.: 647,572

[22] Filed: Jan. 28, 1991

[51] Int. Cl.[5] ..... H05B 6/80

[52] U.S. Cl. ..... 219/10.55 M; 219/10.55 A; 219/10.55 F; 219/10.55 R; 264/26; 264/58

[58] Field of Search ..... 219/10.55 F, 10.55 M, 219/10.55 E; 264/63, 64, 65, 26, 58, 332; 425/174.8; 419/48; 106/39.5; 126/400; 432/258, 262

[56] References Cited

U.S. PATENT DOCUMENTS 3,777,099 12/1973 Levinson ..... 219/10.55 M
4,307,277 12/1981 Maeda et al. ..... 219/10.55 R
4,466,938 8/1984 Gigl et al. ..... 264/332
4,617,439 10/1986 Lespinats et al. ..... 219/10.55 M
4,810,846 3/1989 Holcombe et al. .
4,880,578 11/1989 Holcombe et al. .
4,963,709 10/1990 Kimrey ..... 219/10.55 M

*Primary Examiner*—Bruce A. Reynolds
*Assistant Examiner*—Tuan Vinh To
*Attorney, Agent, or Firm*—Cooper & Dunham

[57] ABSTRACT

A method of heating a workpiece assembly and a load assembly suitable for heating by the method. The method involves heating the workpiece assembly in a microwave cavity surrounded by one or more rings made of electrically conductive material. The rings fix the electrical field in such a way that uniform heating of the workpiece assembly can be achieved. Large workpieces or assemblies can be heated and, if sinterable, sintered in this way without the problems normally caused by lack of uniform fields when microwaves are used to heat large loads.

19 Claims, 2 Drawing Sheets

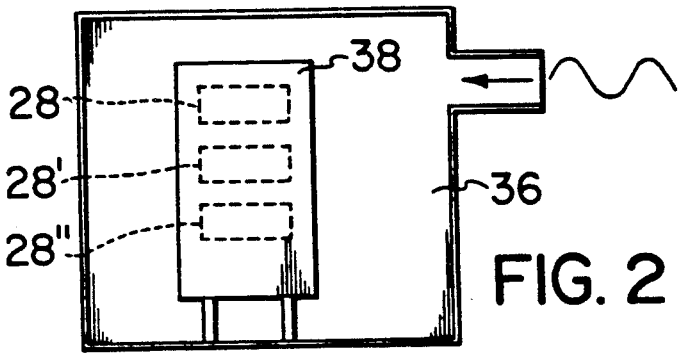
FIG. 2
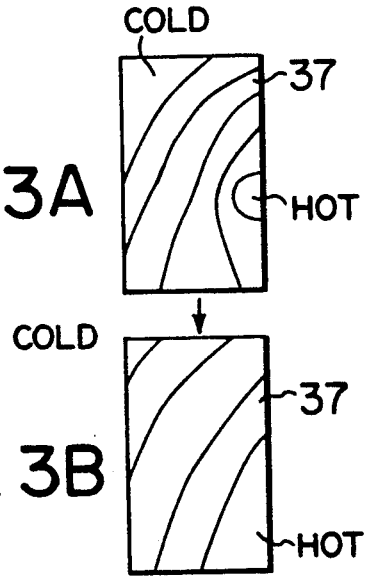
FIG. 3A
FIG. 3B
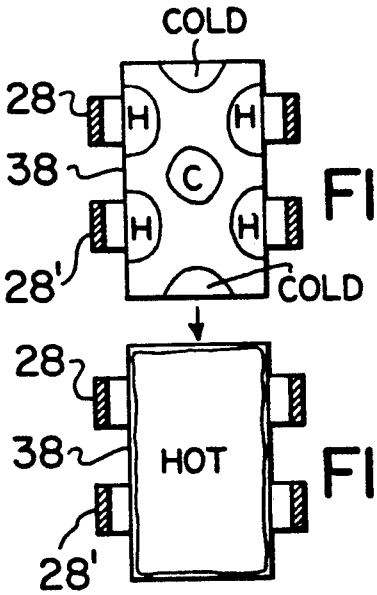
FIG. 4A
FIG. 4B
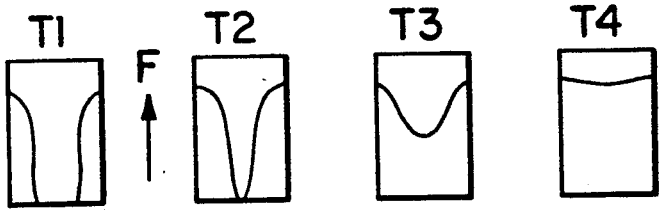
FIG. 5A
FIG. 5D
FIG. 5B FIG. 5C

MICROWAVE HEATING OF WORKPIECES

FIELD OF THE INVENTION

This invention relates to the utilization of microwave energy to heat industrial components to high temperatures, e.g. for sintering, or to drive a physical or chemical reaction, and is particularly concerned with achieving an improved uniformity of heating when the components are large or consist of a number of smaller separate components that are to be heated simultaneously.

BACKGROUND OF THE INVENTION

The heating of industrial articles by microwave energy is attracting much interest these days as an alternative to conventional heating because of the improved speed and economy that can thereby be achieved. A problem which has been encountered, however, is that uniform heating of large volumes is difficult to achieve with microwaves and consequently large workpieces or groups of workpieces may not be heated uniformly. In fact, problems of lack of uniform heating are usually encountered when volumes of more than about one cubic inch (16.4 $cm^3$) are involved. This severely limits the usefulness of microwave heating for those industrial applications in which relatively uniform heating is critical. While it is true that uniform heating of larger volumes and workpieces can be achieved if heating times are suitably prolonged (conduction and convection eventually equalize temperatures), this is obviously not an economic solution to the problem for industrial operations in which an objective is to minimize cycle times.

Even when relatively small workpieces are to be heated, it is more economical to heat a large number of components simultaneously as a relatively large batch rather than to heat them individually, thus it is important to be able to heat large volumes uniformly even with such small components.

A primary area of utilization of the invention is in the sintering of ceramic components, e.g. one or more large ceramic components, or a comparatively large number of smaller ceramic components, that are to be heated to a sintering temperature. In such cases, lack of uniformity during the heating step can result in lack of uniform density of the products. Uniformity of heating is therefore particularly important in such cases.

Similar lack of uniformity of heating has been observed when microwave energy is employed for heating ceramic components for the removal of binders, or for drying workpieces generally, or for driving physical or chemical reactions. Generally speaking, the more massive the workpiece or the assembly of workpieces, the more pronounced the non-isothermal nature of the process becomes, and this experience has in the past tended to limit the size of the workpiece assembly that it has been possible to heat with microwave energy, if quality standards are to be maintained.

In the following specification and claims, the term "workpiece assembly" has been adopted to describe either a single, bulky workpiece or starting material, or, more often, a relatively large number of smaller workpieces that together make up a bulky assembly.

PRIOR ART

There have been numerous efforts in the past to make microwave fields more uniform, such as multiple slot entry techniques or the development of so-called "stirred" multimode cavities, in which the field is constantly shifted in order to try to achieve an averaging out of the "hot" and "cold" spots. While these efforts have provided some improvement, the fact remains that, prior to the present invention, it has not been possible to achieve in a comparatively bulky workpiece assembly conditions that are as close to isothermal as is desired.

At 2.45 GHz a far better uniformity of field can be obtained by increasing the cavity dimensions better than 100 times the wavelength which would require a cavity size of 12 m or so. At this size however, a very large power supply would be required to produce a reasonable energy density within the cavity. This is therefore not feasible. A way around this has been to go to higher frequencies, as high as 28 GHz where 100 times the wavelength is approximately 1 m in size (see U.S. Pat. No. 4,963,709 to Harold D. Kimrey issued on Oct. 16, 1990). This is a far more manageable size of cavity and a reasonable energy density can be obtained with a moderate power source. However, a frequency of 28 GHz is considered to be inhibitively expensive for commercial use.

SUMMARY OF THE INVENTION

To be suitable for industrial use, heating by microwave energy needs to be adaptable to large volumes. While the heating of large volumes by microwave energy can probably never be exactly isothermal, there is much need in industry for achieving conditions that are nearer to isothermal than those that have hitherto been obtainable. Hence, the principle object of the present invention is to achieve an improvement in this respect, and moreover to achieve it without any need to adopt a frequency higher than the standard 2.45 GHz.

More specifically, when the workpiece assembly consists of a relatively large number of ceramic components that are to be sintered simultaneously, it is an object of the present invention to be able to heat this assembly by microwave energy under conditions that sufficiently closely approach the isothermal that the final sintered products will be of uniform density within tolerances acceptable in the industry.

To this end the invention consists of a method of subjecting a heat densifiable workpiece assembly to substantially uniform heating by microwave energy, which comprises: positioning the assembly in a multimode microwave cavity of a microwave heating device, surrounding the assembly with at least one electrically conductive ring; and irradiating the cavity with microwave energy.

More specifically, the invention provides a method of heating a workpiece assembly, comprising constructing a load assembly comprising: (a) a crucible, (b) a powder bed in the crucible, (c) a workpiece assembly embedded in the powder bed, (d) at least one electrically conductive ring closely adjacent to the crucible surrounding the workpiece assembly, and (e) thermal insulation surrounding the crucible and said ring, and irradiating said load assembly with microwave energy in a multimode cavity whereby to subject the workpiece assembly to substantially isothermal conditions such that the variation in density of the finished article is no more than $\pm 1\%$.

The invention also relates to a load assembly for use in carrying out this method.

By the term "electrically conductive ring" as used throughout this disclosure and claims, we mean a body of material having an electrical conductivity (at least at treatment temperatures) typical of metals or conductive non-metals such as graphite or SiC. Materials that do not have appreciable skin depths (i.e. depths to which the electric field penetrates) are suitable, e.g. skin depths of less than approximately 10 μm. The body is generally cylindrical, annular or toroidal but need not be of circular cross-section (although it normally is) and could be, for example, triangular or square if required to produce a more uniform field. The ring is normally continuous (unbroken) such that it behaves as a waveguide. There could be situations where the ring is broken while still providing acceptable waveguide effects, but these situations would be exceptional. In any event, the ring is open at the top and bottom and is normally of smaller vertical height than the workpiece assembly with which it is used.

BRIEF DESCRIPTION OF THE DRAWINGS

FIG. 2 illustrates one manner in which the load assembly of FIG. 1 can be mounted in a microwave cavity; and FIGS. 3(*a*), 3(*b*), 4(*a*), 4(*b*) and 5(*a*) to (*d*) are graphical representations demonstrating the effects obtained with the embodiment of FIG. 1.

DETAILED DESCRIPTION OF THE INVENTION AND PREFERRED EMBODIMENTS

Figure 1:
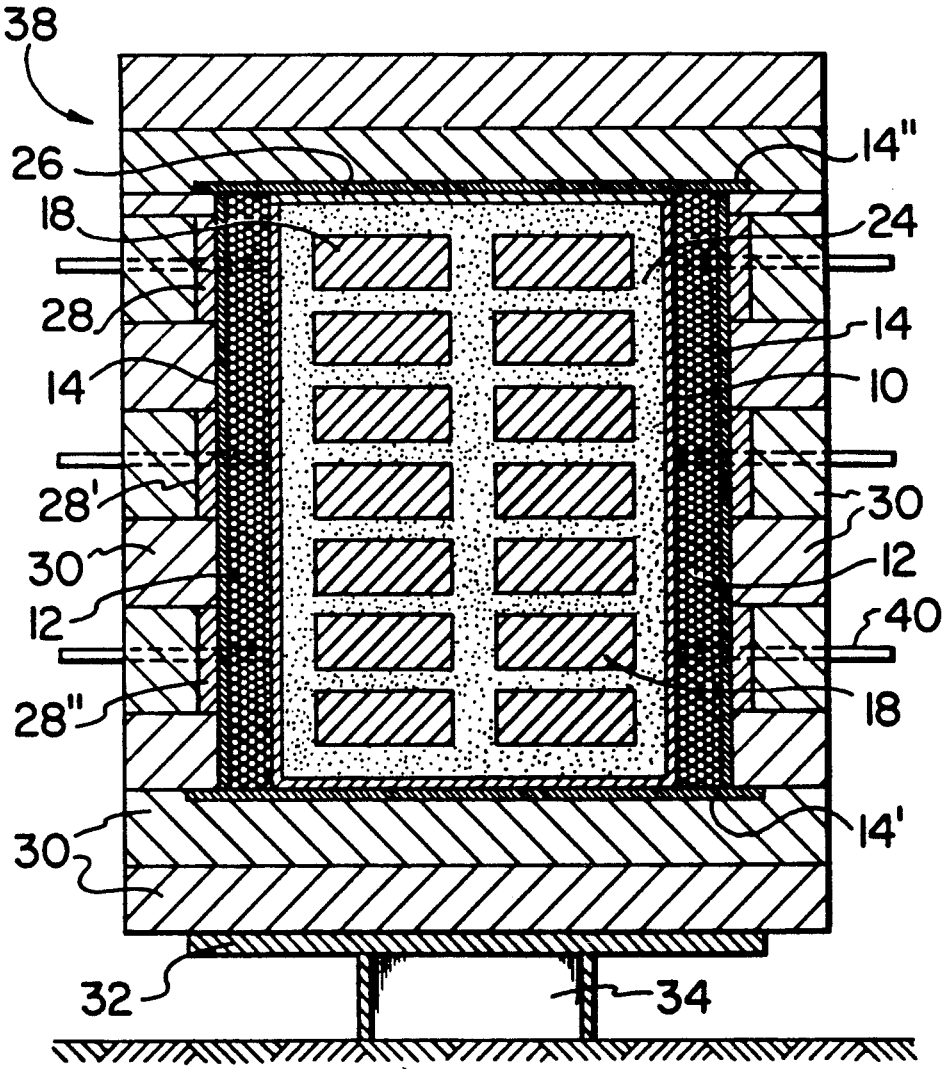
FIG. 1 is a diagrammatic cross-section of a load assembly for sintering ceramic components, according to a preferred embodiment of the invention.

In the present invention, more uniform heating of large volumes by microwave energy can be achieved by surrounding the volume to be heated by at least one ring of material that is electrically conductive at the microwave treatment temperatures.

Applicants theorize that the observed improvement of heating uniformity caused by the presence of the rings is the result of at least one, and to some degree probably all, of the following factors:

(a) the fixing by each ring of a relatively stable microwave field distribution within the volume defined by the ring, (b) the production of a radial fringe field between the rings, when more than one ring is used, and (c) the good thermal conduction that the rings represent to help in dissipating any local heating.

The rings can be used singly to fix the field around a single relatively small workpiece assembly or can be stacked vertically, preferably electrically isolated from each other and all other nearby articles, with a gap between them. If the gap between rings is increased excessively, there is a tendency for non-uniform heating to occur. On the other hand, if the rings are positioned too close to each other, overlap of the fields results in an intermediate zone of intense local heating which causes a diminution of the field uniformity. The preferred spacing between the rings is 10–30 mm, and more usually 10–20 mm, at a frequency of 2.45 GHz.

The diameter of each ring depends on the shape and volume of the load to be heated, the dielectric properties of the material forming the ring and the desired field distribution, but preferably ranges from less than 25 mm in diameter to greater than 300 mm in diameter. Ideally, the rings should be spaced less than about half a wavelength (of the microwave radiation) from the workpiece assembly (i.e. free space between the inner surface of the ring and the outer surface of the workpiece assembly). The thickness of the ring is thought not to play a significant part, provided that it is thicker than a certain amount, so as not to be transparent to microwaves, and not to heat appreciably through surface resistive heating. The depth of each ring normally ranges from less than 1 mm to greater than 30 mm.

The number, dimensions and separation of the rings employed in any particular case can be found by simple trial and experimentation with suitable changes or adjustments being made to create the desired uniform field. The axis perpendicular to the plane of the ring(s) should preferably be parallel to the central vertical axis of the load. Once the uniform field has been created, the workpiece assembly can be positioned anywhere and in any orientation within the affected volume of space.

The workpiece assembly is normally buried within a powder bed. The powder bed has the property of insulating the components being sintered and, in the case of low loss materials, can also be a microwave susceptor, if desired. When treating non-oxide ceramics, the powder bed can have the functions of:

1) Being a microwave susceptor, if necessary.
2) Providing a protective atmosphere to inhibit degradation.
3) Providing an atmosphere low in oxygen, to avoid oxidation.
4) Being a good thermal conductor to improve temperature uniformity.

The workpiece assembly and the powder bed are normally held within a suitable heat resistant container referred to as a crucible. The crucible is normally microwave transparent, but in some situations it may be desirable to make the crucible out of a susceptor material so that the crucible first heats up and then heats the contents by conduction in order to make the contents susceptible to the microwaves.

In normal circumstances, the rings surround the container with a slight gap (as mentioned above). However, the rings may alternatively be placed snugly inside the crucible or made part of the outer crucible wall. For example, a refractory crucible having a thin metal (e.g. platinum) coating on the inside or outside surfaces of the wall would be effective.

The thermal conditions in the crucible will vary with time, due to heat losses from its surfaces and due to an increase in the dielectric constant (lossiness, or ability to absorb microwave energy) of the load assembly, especially the powder bed, at elevated temperatures.

An example of a load arrangement including electrically conductive rings is shown in FIG. 1 of the accompanying drawings. The Figure shows a cylindrical crucible 10 of alumina, that is insulated around its cylindrical wall by means of a large number of zirconia balls 12. These balls 12 are held in place by an outer cylindrical layer 14 of zirconia felt. A base 14' of zirconia felt underlies the bottom of the crucible 10 and a further layer 14" overlies the top of the crucible 10.

The workpiece assembly inside the crucible 10 consists of a number of ceramic components 18 that are to be sintered. These components 18 are shown arranged in generally equally vertically spaced layers. Within each layer, the individual components 18 can be arranged in any convenient orientation. Depending on their size relative to the diameter of the crucible, the components 18 might, for example, be arranged with one at the center and the others arranged circumferentially around it. For smaller components, there could be more than one concentric ring of components, or simply a series of rows of components. The orientation of the components 18 shown in FIG. 1 is purely diagrammatic.

In any event, however arranged, the components 18 are spaced apart and embedded in a powder bed 24. In a specific experiment carried out in the laboratory, sixty three components 18, each consisting of a green powder compact of silicon nitride weighing 5 grams, were packed in nine layers of seven components per layer, in a powder bed 24 of silicon nitride, silicon carbide and boron nitride (the powder bed being in accordance with the invention disclosed, in our copending U.S. Pat. application Ser. No. 852,158 filed via the Patent Cooperation Treaty on Oct. 19, 1990, Ser. No. PCT/CA90/00358; the disclosure of which is incorporated herein by reference). The crucible 10 was approximately 90 mm in diameter and a layer 26 of pure silicon nitride was used to seal the top of the powder bed 24.

Arranged outside the insulating layer 14 there were three vertically spaced conductive rings 28, 28' and 28'' made of titanium (although other metals could have been used, or any other electrical conductor at high temperature, e.g. a ceramic, such as zirconia or silicon carbide). These rings 28, 28', 28'' were held in place by, and the apparatus was insulated by, numerous variously dimensioned blocks 30 of thermal insulating material, e.g. saffil fiber, the blocks 30 surrounding and supporting the rings and the crucible 10, with the lowermost block resting on a quartz disc 32 that in turn rested on a quartz cylinder 34.

In this equipment, the rings 28, 28', 28'' were each 110 mm in diameter and 30 mm in depth, with a spacing between the adjacent pairs of rings of 13 mm (if desired, the rings could have been spaced by a low loss material such as boron nitride). The rings were electrically isolated from each other.

The entire load assembly, which is designated in FIG. 1 as 38, and consisted of the workpiece components 18, powder bed 24, crucible 10, rings 28 etc. and the associated insulation, was heated in a multimode cavity 36, as shown in FIG. 2. The load assembly 38 was heated in the cavity 36 for a total cycle time of 115 minutes (60 minutes heating time and 55 minutes holding time), while the temperature of the crucible 10 was monitored at six positions as shown by the temperature probes 40 that extend through the rings 28 etc. and through the various layers of insulation. These probes temperatures of from 1500° to 1594° C., and the final result was the production of sixty three pellets of ceramic that had been sintered to a density of 94.5% ±1%, which is a remarkably uniform density to achieve when sintering such a relatively large number of components simultaneous, and is noticeably better than it had previously proved possible to achieve in a similar crucible without the rings 28, 28' and 28''.

This experiment was repeated several times using only two rings, i.e. a load of 40 pellets, the rings having a separation of 20 mm. In several cases the temperature variation across the bed was only ±20° C. and the pellets were sintered to a density within ±1% of a mean value equal to approximately 95.5% of the theoretically perfect density.

In another experiment the load assembly of FIG. 1 was modified to contain 6 rows of pellets of silicon nitride (green). Each row consisted of two pellets approximately two inches long by one and a half inches by one inch. Each pellet weighed 45 grams and the total load was 530 grams. The load was irradiated and it was found that the sintering temperature at the top, bottom and middle sides of the crucible were 1590° C., 1582° C. and 1599° C., respectively. The density variation of the resulting pellets was 96.5% ±0.4%.

For a load 37 without rings, FIGS. 3(*a*) and (*b*) respectively illustrate typical isotherms that are believed to arise between hot and cold areas at the initiation of heating, and after the heating has been in progress for some time. When a pair of rings 28, 28' is used, the respective conditions for the load 38 at the beginning and end of the heating process are believed to be as shown in FIGS 4(*a*) and (*b*) respectively. It is to be understood that these diagrams, especially FIGS. 3(*a*) and (*b*), are merely intended to be representative of one form of lack of thermal uniformity that may arise. Depending on the dimensions and nature of the load assembly 37, the locations and extents of the various hot and cold regions can be expected to vary. However, experience has shown that regions with undesirably wide variations of temperature will arise somewhere in the load whenever an attempt is made to increase the size of the workpiece assembly by simultaneously irradiating more than one or more than a very few ceramic components with microwave energy. Similarly, it should be made clear that FIGS. 4(*a*) and (*b*) are not the result of measurements, since it has not proved possible to measure the internal temperatures throughout the load 38, but are based to some degree on conjecture (in the case of FIG. 4(*a*)), and largely on the excellent final results obtained in the finished workpieces (in the case of FIG. 4(*b*)).

FIGS. 5(*a*) to (*d*) show one possible distribution of the microwave field F across the crucible 10 from time T1 to T4, as the heating process progresses, these diagrams having again been arrived at theoretically, since actual measurement of the field distribution has not proved feasible. The steady improvement in field uniformity as time progresses is largely attributed to the increase in lossiness of the load assembly and especially the powder bed that comes about at higher temperatures.

We claim:

1. A method of heating a heat-densifiable workpiece assembly, comprising constructing a load assembly comprising:

(a) a crucible, (b) a powder bed in the crucible, (c) a workpiece assembly embedded in the powder bed, (d) at least two stacked, spaced, electrically conductive rings closely adjacent to the crucible surrounding the workpiece assembly, and (e) thermal insulation surrounding the crucible and said rings, and irradiating said load assembly with microwave energy in a multimode cavity whereby to subject the workpiece assembly to substantially isothermal conditions in which a variation in density of a finished article is no more than ±1%.

2. A method according to claim 1, wherein said workpiece assembly comprises a sinterable material and said irradiation with said microwave energy raises the temperature of said workpiece assembly to a sintering temperature.

3. A method according to claim 1, wherein each of said rings is spaced from another by a distance in the range of 10–30 mm.

4. A method according to claim 1, wherein each of said rings has a diameter in the range of 25–300 mm.

5. A method according to claim 1, wherein each of said rings is spaced from said workpiece assembly by a free space of about one half of the wavelength of said microwave energy.

6. A method according to claim 1, wherein the workpiece assembly consists of a number of workpiece components spaced apart within the powder bed.

7. A method according to claim 6, wherein the workpiece components are arranged in a plurality of layers.

8. A method according to claim 6, wherein the workpiece components are green powder compacts of silicon nitride, and the powder bed is a mixture of silicon nitride, silicon carbide and boron nitride, said irradiation subjecting the workpiece components to a sintering temperature.

9. A method according to claim 1, wherein the microwave energy has a frequency of 2.45 GHz or less.

10. A load assembly for irradiation with microwave energy, comprising (a) a crucible, (b) a powder bed in the crucible, (c) a workpiece assembly embedded in the powder bed, (d) at least two stacked, spaced, electrically conductive rings closely adjacent to the crucible surrounding the workpiece assembly, and (e) thermal insulation surrounding the crucible and said rings.

11. A load assembly according to claim 10, wherein said workpiece assembly comprises a sinterable material and said irradiation with said microwave energy raises the temperature of said workpiece assembly to a sintering temperature.

12. A load assembly according to claim 10, wherein each of said rings is spaced from another by distance in the range of 10–30 mm.

13. A load assembly according to claim 10, wherein each of said rings has a diameter in the range of 25–300 mm.

14. A load assembly according to claim 10, wherein each of said rings is spaced from said workpiece assembly by a free space of about one half of the wavelength of said microwave energy.

15. A load assembly according to claim 10, wherein the workpiece assembly consists of a number of workpiece components spaced apart within the powder bed.

16. A load assembly according to claim 15, wherein the workpiece components are arranged in a plurality of layers.

17. A load assembly according to claim 15, wherein the workpiece components are green powder compacts of silicon nitride, and the powder bed is a mixture of silicon nitride, silicon carbide and boron nitride.

18. A method of subjecting a body of material to substantially uniform heating by microwave energy, which comprises:

positioning said body in a multimode microwave cavity of a microwave heating device;

surrounding the body with at least two stacked, spaced, electrically conductive rings; and irradiating the cavity with microwave energy.

19. In a process of heating an assembly by means of microwaves by positioning the assembly inside a multimode cavity and introducing microwaves into the cavity, an improvement which comprises surrounding the body with at least two stacked, spaced, electrically isolated rings of electrically conductive material positioned and dimensioned to create a substantially uniform electric field within the assembly.

* * * * *